US005240826A

United States Patent [19]

Miyasaka et al.

[11] Patent Number: 5,240,826

[45] Date of Patent: Aug. 31, 1993

[54] SILVER HALIDE PHOTOGRAPHIC LIGHT-SENSITIVE MATERIALS

[75] Inventors: Nobuaki Miyasaka; Hideo Ikeda; Shigeru Ohno, all of Minami-Ashigara, Japan

[73] Assignee: Fuji Photo Film Co., Ltd., Minami-Ashigara, Japan

[21] Appl. No.: 788,344

[22] Filed: Nov. 6, 1991

Related U.S. Application Data

[63] Continuation of Ser. No. 541,086, Jun. 18, 1990, abandoned, Continuation of Ser. No. 318,511, Mar. 6, 1989, abandoned, Continuation of Ser. No. 937,538, Dec. 3, 1986, abandoned.

[30] Foreign Application Priority Data

Dec. 5, 1985 [JP] Japan ..... 60-274160

[51] Int. Cl.[5] ..... G03C 1/06

[52] U.S. Cl. ..... 430/600; 430/445; 430/448; 430/571; 430/558; 430/611; 430/523

[58] Field of Search ..... 430/445, 448, 571, 558, 430/600, 611, 523

[56] References Cited

U.S. PATENT DOCUMENTS

| | | | |
|---|---|---|---|
| 4,607,004 | 8/1986 | Ikenoue et al. | 430/600 |
| 4,657,847 | 4/1987 | Ikeda et al. | 430/611 |
| 4,873,181 | 10/1989 | Miyasaka et al. | 430/523 |

FOREIGN PATENT DOCUMENTS

| | | | |
|---|---|---|---|
| 0189840 | 8/1986 | European Pat. Off. . | |
| 0334162 | 9/1989 | European Pat. Off. | 430/600 |

*Primary Examiner*—Charles L. Bowers, Jr.
*Assistant Examiner*—Thomas R. Neville
*Attorney, Agent, or Firm*—Burns, Doane, Swecker & Mathis

[57] ABSTRACT

A novel silver halide photographic light-sensitive material having at least one silver halide photographic emulsion layer coated on at least one side of a support, wherein said photographic emulsion layer comprises a light-sensitive silver halide emulsion and said photographic emulsion or other layer(s) comprises a substantially light-insensitive, unfogged silver halide fine grain emulsion, with a heterocyclic mercapto compound represented by the following general formula (I) being adsorbed on the fine grains in said emulsion: general formula (I)

wherein X represents —O—, —NH—, or —S—; $R_1$, $R_2$, $R_3$ and $R_4$ are a hydrogen atom or a substituent group; at least one of $R_1$, $R_2$, $R_3$ and $R_4$ is a substituted or unsubstituted alkyl or aryl group having up to 13 carbon atoms, such alkyl or aryl being bonded directly or through a divalent linkage group to the aromatic nucleus; $X_1$ represents a hydrogen atom or a cation, such cation being required to neutralize the molecule.

The silver halide photographic light-sensitive material is a high-speed material which exhibits improved granularity, gradation and rate of development.

19 Claims, No Drawings

SILVER HALIDE PHOTOGRAPHIC LIGHT-SENSITIVE MATERIALS

This application is a continuation of application Ser. No. 07/541,086, filed Jun. 18, 1990; which is a continuation of Ser. No. 07/318,511, filed Mar. 6, 1989, now abandoned; which is a continuation of Ser. No. 06/937,538, filed Dec. 3, 1986, now abandoned.

BACKGROUND OF THE INVENTION (1) Field of the Invention

This invention relates to silver halide photographic light-sensitive materials (hereinafter referred to as "photographic light-sensitive materials"), more particularly, to high-speed photographic light-sensitive materials which exhibit improved granularity, gradation and rate of development.

(2) Description of the Prior Art

In general, with silver halide photographic light-sensitive materials, increasing iodide content is desirable to make the sensitivity high. This is principally due to increased absorptivity of blue light by shifting the range of the wavelength in which the materials are light-sensitive to the longer wavelength side. However, increase of the iodide content causes a disadvantage, namely a reduction in of the rate of development. In such a situation although good granularity is obtained when an ordinary developing solution is used, good granularity and little change in sensitivity and the like due to developing solution temperature cannot be obtained when a developing solution containing a dialdehyde hardener is used since infectious development occurs. It is known that the addition of a nonion surface-active agent having a polyoxyethylene chain per a molecule as described in British Patent No. 861134 and German Patent No. 1422809 is effective for improving the delay of the rate of development resulting from increase of iodide content but often causes deterioration of granularity and, when the developing solution containing dialdehyde hardener is used, as disclosed in Japanese Patent Disclosure No. 76743/1985, causes a pressure effect or pressure fog in the developing solution (so-called roller-mark). Moreover, in order to prevent infectious development from occurring in a developing solution, various techniques have been disclosed and are described below:

For instance, the prevention of yellow fog by the addition of nitron salt, 1,4-diphenyl-3,5-endoanilin-4,5-dihydro-2,4-triazole, or 3,5,6-triphenyl-2,3,5,6-tetrazabicyclo(2,1,1)hexlen is described in Japanese Patent Publication No. 28691/1977 and RD-18431, page 434, the improvement of the change in sensitivity and the like depending on processing temperature (hereinafter referred to as dependence on processing temperature") by the addition of mesoiontriazolium compound other than nitron is described in Japanese Patent Disclosure Nos. 87322/1985, 117240/1985 and 122936/1985, the prevention of fog by mercapto compounds and benzotriazole compounds is described in US Patent Nos. 3954474, 3982947 and Japanese Patent Publication No. 28660/1977, the prevention of fog occurring in a color developing solution by blue spectral sensitization dye is described in US Patent Nos. 2131038 and 3930860 and Japanese Patent Disclosure Nos. 61519/1979 and 119917/1980, and the improvement of the dependence on processing temperature by some blue spectral sensitization dyes is described in Japanese Patent Disclosure Nos. 55426/1984 and 165049/1984. However, these methods have disadvantages such as desensitization and pressure fog.

For example, although mesoiontriazolium compound has improved dependence on processing temperature, it has large desensitizing effect (it also exhibits large desensitizing effect when a developing solution containing no dialdehyde is used). Mercapto compounds have large desensitizing effect in comparison with the dependence on the processing temperature thereof. The blue-light spectral sensitization dye increases pressure fog.

SUMMARY OF THE INVENTION

Accordingly, an object of this invention is to provide high speed silver halide photographic light-sensitive materials which contain silver iodide and have an improved rate of development.

Another object of this invention is to provide silver halide photographic light-sensitive materials containing silver iodide which exhibit low degree of infectious development when developing them in a developing solution containing a dialdehyde type hardener and which have good granularity.

The object of this invention can be attained by a silver halide photographic light-sensitive material having at least one photographic emulsion layer coated on at least one side of a support characterized in that, said photographic emulsion layer comprises a light-sensitive silver halide emulsion (hereinafter referred to as the "first emulsion") comprising silver halide grains containing silver iodide and said photographic emulsion layer or other layer(s) (such as a surface protective layer) contain a substantially light-insensitive, unfogged silver halide fine grain emulsion, with heterocyclic mercapto compound represented by the following general formula (I) being absorbed on said fine grain in said emulsion:

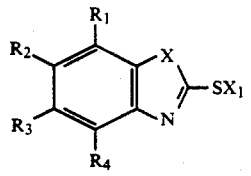

general formula (I)

Wherein X represents —O—, —NH—or —S—; $R_1$, $R_2$, $R_3$ and $R_4$ are a hydrogen atom or a substituent group; at least one of $R_1$, $R_2$, $R_3$ and $R_4$ is a substituted or unsubstituted alkyl or aryl group having up to 13 carbon atoms, such alkyl or aryl being bonded, directly or through a divalent linkage group to the aromatic nucleus; $X_1$ represents a hydrogen atom or a cation, such cation being required to neutralize the molecule.

DETAILED DESCRIPTION OF THE INVENTION

The compound represented by the formula (I) is illustrated as follows:

X represents —O—, —NH—or —S—. Preferably, X is —NH—.

$R_1$, $R_2$, $R_3$ and $R_4$ represent individually a hydrogen atom or a substituent group Preferably, $R_1$, $R_2$, $R_3$ and $R_4$ represent hydrogen atom, halogen atom (e.g., fluorine atom, chlorine atom, bromine atom, etc.), substituted or unsubstituted alkyl (e.g. methyl, ethyl, trifluoromethyl, n-octyl, benzyl, etc ), substituted or unsubstituted aryl (e.g., phenyl, p-chlorophenyl, etc.), substituted or unsubstituted alkoxy, aryloxy (e.g., methoxy, n-hexyloxy, n-octyloxy, phenoxy, 2-ethylhexyloxy, etc.), sulfonyl (e.g., methanesulfonyl, p-toluenesulfony, etc ), sulfonamido (e.g., n-octanesulfonamido, p-toluenesulfonamido, etc.), sulfamoyl (e.g., diethylsulfamoyl, 4-chlorophenylsulfamoyl, etc.), carbamoyl (e.g., n-butylcarbamoyl, 4-cyanophenylcarbamoyl, 2-ethylhexycarbamoyl, etc.), amido (e.g., n-hexaneamido, n-decaneamido, benzamido, 2-ethylhexaneamido, etc.), ureido (e.g., 3-butylureido, morpholinocarbonylamino, etc.), aryloxycarbonylamino, alkoxycarbonylamino (e.g., ethoxycarbonylamino, iso-butylcarbonylamino, phenoxycarbonylamino, etc.), aryloxycarbonyl, alkoxycarbonyl (e.g., ethoxycarbonyl, phenoxycarbonyl, etc.), arylaminocarbonyloxy, alkylamino-carbonyloxy (e.g., phenylaminocarbonyloxy, iso-butylaminocarbonyloxy, etc.), cyano, arylthio, alkylthio (e.g., n-octylthio, 2-methylcarbonylphenylthio, etc.). Preferably, a substituent group represented by $R_1$–$R_4$ has up to 13 carbon atoms, preferably up to 11. At least one of $R_1$, $R_2$, $R_3$ and $R_4$ is a substituted or unsubstituted alkyl or aryl having 1 to 13 carbon atoms, preferably 5 to 11 carbon atoms, such alkyl or aryl being bonded, directly or through a divalent linkage group, to the aromatic nucleus.

Examples of suitable divalent linkage groups included in $R_1$, $R_2$, $R_3$ and $R_4$ include amido, sulfonamido, ureido, ether, thioether, sulfonyl, carbonyl, urethane, carbamoyl and sulfamoyl linkages.

$X_1$ represents a hydrogen atom or a cation, such cation being required to neutralize the molecule (e.g., sodium ion, potassium ion, ammonium ion, etc.).

Typical Examples of compounds which can be used in this invention include the following to which this invention is not restricted.

1

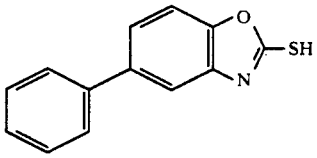

2

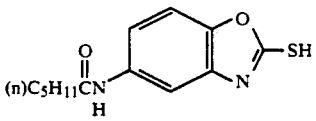

3

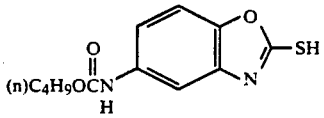

4

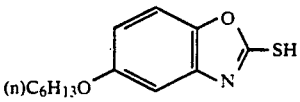

5

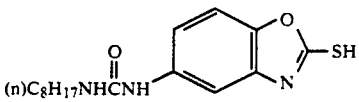

-continued

6

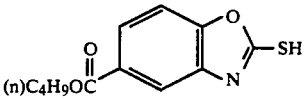

7

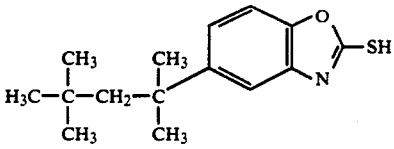

8

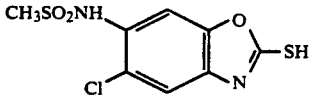

9

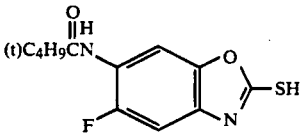

10

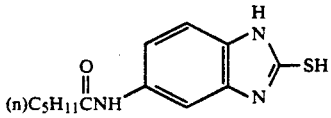

11

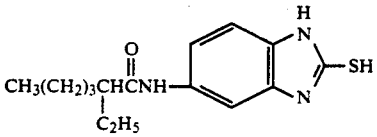

12

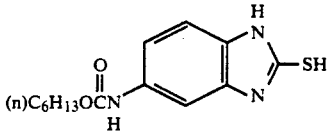

13

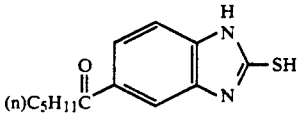

14

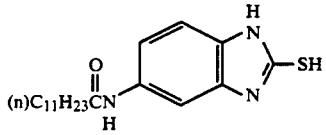

15

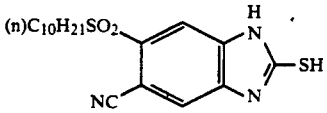

16

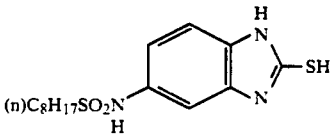

-continued
17
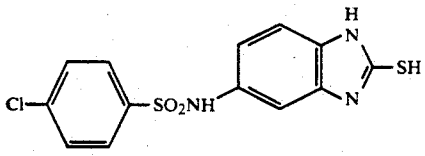
18
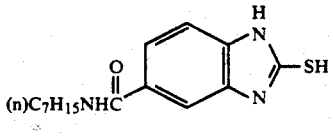
19
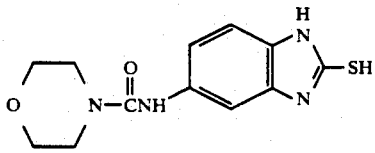
20
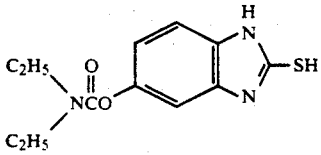
21
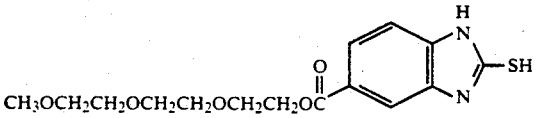
22
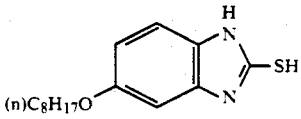
23
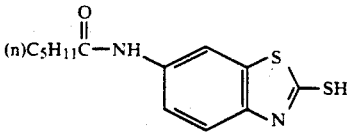
24
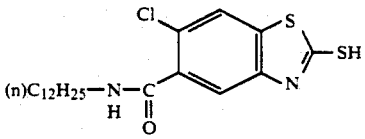
25
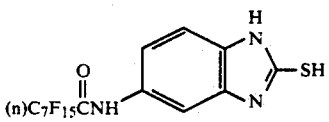
26
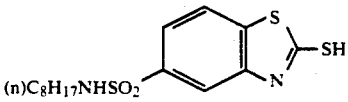
27
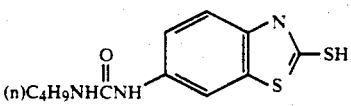
-continued
28
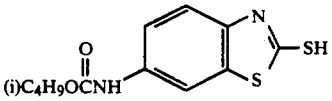
29
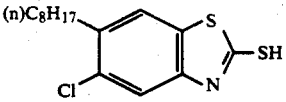
30
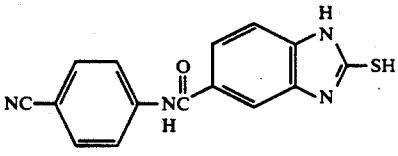
31
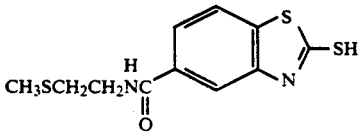
32
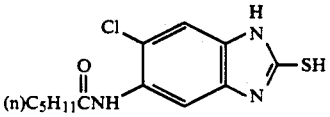
33
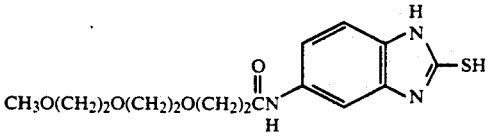
34
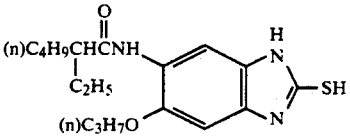
35
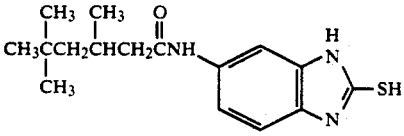
36
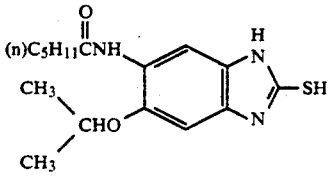
37
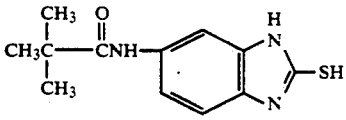
38
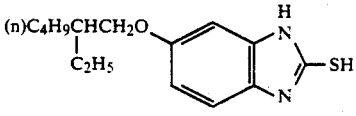

-continued

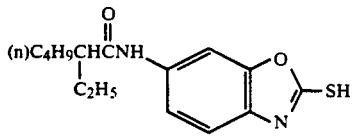

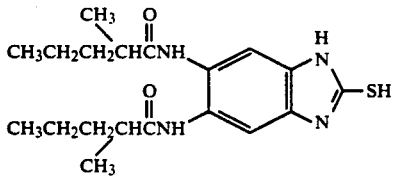

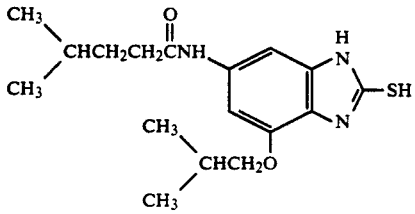

The compounds represented by the formula (I), which can be used in this invention, can be prepared according to the method as described in J. Van Allan. B. D. Deacon, Org Synth., IV, 569 (1963), J. Bunner Ber., 9, 465 (1876), L. B Sebrell, C. E. Boord, Am. Chem. Soc., 45, 2390 (1923) or the following typical synthetic examples.

Synthetic Example 1

Synthesis of Compound 10

5-Amino-2-mercaptobenzoimidazol (8.3 g) was dissolved in pyridine (120 ml) and was dropwise added with hexanoylchloride (6.7 g) under ice-cooled conditions. After agitation at room temperature for 2 hours, the resulting mixture was poured into ice-cold water (800 ml) to precipitate crystal. The precipitated crystal was filtered and recrystallized from a mixed solvent of ethanol and water. Yield 7.89 g. m.p. 262° to 264° C. (dec).

Synthetic Example 2

Synthesis of Compound 14

5-Amino-2-mercaptobenzoimidazol (8.3 g) was dissolved in pyridine (120 ml) and was dropwise added with lauroylchloride (12 g). After agitation at room temperature for 3 hours, the resulting mixture was poured into ice-cold water (800 ml) to precipitate crystal. The precipitated crystal was filtered and recrystallized from a mixed solvent of ethanol and water. Yield 10.2 g. m.p. 266° to 267° C. (dec).

Synthetic Example 3

Synthesis of Compound 18

5-Carboxy-2-mercaptobenzoylimidazol (5.8 g) was added to DMF (60 ml) and the resulting mixture was dropwise added with triethylamine (6.3 ml) and chloroethyl formate (4.3 ml) under ice-cooled condition After agitation under ice-cooled conditions for 30 minutes, heptylamine (5.2 g) was dropwise added to the resulting mixture and followed by additional agitation for 4 hours The reaction mixture was added to sodium hydrogencarbonate (3 g) in water (500 ml) to produce precipitate. The resulting precipitate was recrystallized from ethyl acetate. Yield 3.8 g. m.p. 230° to 232° C.

Synthetic Example 4

Synthesis of Compound 22 p-Octyloxy-o-phenylenediamine (4.7 g) was added to potassium hydroxide (1.2 g) in ethanol (60 ml) and then the mixture was dropwise added with carbon disulfide (6 ml) at 50° C. After reflux for 4 hours, the resulting mixture was added to ice-cold water (150 ml) and concentrated hydrochloride (3 ml) was added to the mixture under agitation to produce precipitate. The precipitate was recrystallized from acetonitrile. Yield 3.7 g. m.p. 230° to 232° C.

Synthetic Example 5

Synthesis of Compound 23

6-Amino-2-mercaptobenzothiazol (9.1 g) was added to pyrizine (70 ml) and hexanoylchloride (6.7 g) was dropwise added to the resulting mixture under ice-cooled conditions. After agitation at room temperature for 3 hours, ice-cold water was added to the resulting mixture to precipitate crystal. The precipitated crystal was filtered and recrystallized from a mixed solvent of ethanol and water. Yield 6.9 g, m.p. 179 to 180° C.

The compound represented by the formula (I) may be used in this invention in an amount of $1\times10^{-3}$ to 10 mole, preferably $1\times10^{-2}$ to 1 mole per mole of silver halide grains in substantially light-insensitive silver halide emulsion Most preferably, the compound is used in nearly saturated adsorption on the surface of the substantially light-insensitive silver halide grains. The compound may be added directly to the hydrophilic colloid to be dispersed therein or may be added after dissolved in such an organic solvent as methanol, ethyleneglycol or the like. Light-insensitive grain emulsion which does not contain the compound represented by the formula (I) or light-insensitive grain emulsion added with the compound other than the compound represented by the formula (I) are not preferred because the silver halide grains in such emulsion are dissolved at the preparatory step prior to application of the emulsion Moreover, the internally fogged light-insensitive fine grain emulsion added with the compound of the formula (I) is not preferred because of its undesired fog.

In the photographic light-sensitive materials according to this invention, the first emulsion and the second emulsion may be contained in the same emulsion layer or may be contained individually in different emulsion layer When the emulsions are contained in the same emulsion layer, it is preferred that the emulsions be added to the light-sensitive emulsion after the light-insensitive silver halide grains after treated with the compound represented by the general formula (I).

It is preferred that the second emulsion which may be used in this invention be light-insensitive in comparison with the first emulsion and be an emulsion which does not act to increase the density of the image.

The term "light-sensitive" used in this specification means that the sensitivity of the light-sensitive silver halide emulsion (first emulsion) is higher than that of the second emulsion. More specifically, the sensitivity of the first emulsion is more than 100 times, more preferably more than 1000 times higher than that of the substantially light-insensitive silver halide emulsion.

The term "sensitivity" used herein is defined below.

Two types of emulsion used in this invention are illustrated as follows:

The photosensitive silver halide emulsion which can be used in this invention can be any conventional silver halide emulsion, e.g., a surface latent image type emulsion.

The surface latent image type emulsion used in this specification means such emulsions that the sensitivity thereof obtained by the surface development (A) described below after exposure for 1 to 1/100 second is higher, preferably more than 2 times higher than that obtained by the internal development (B) described below:

Sensitivity is defined as follows:

$$S = \frac{100}{Eh}$$

wherein S is sensitivity and Eh is the exposure value required for obtaining the average of the maximum density (Dmax) and the minimum density (Dmin.), that is, ½(Dmax+Dmin).

Surface development (A)

Developing is done at 20° C. for 10 minutes in a developing bath of the following composition:

| | |
|---|---|
| N-Methyl-p-aminophenol (hemi sulfate) | 2.5 g |
| Ascorbic acid | 10 g |
| Sodium metaborate tetrahydrate | 35 g |
| Potassium bromide | 1 g |
| Water to | 1 l |

Internal development (B)

After treatment in a bleaching bath containing ferricyanide (3 g/l) and phenosafranine (0.0126 g/l) at about 20° c. for 10 minutes and rinsing for 10 minutes, developing is done at 20° C. for 10 minutes in a developing bath of the following composition:

| | |
|---|---|
| N-Methyl-p-aminophenol (hemi sulfate) | 2.5 g |
| Ascorbic acid | 10 g |
| Sodium metaborate tetrahydrate | 35 g |
| Potassium bromide | 1 g |
| Sodium thiosulfate | 3 g |
| Water to | 1 l |

Specific examples of the light-sensitive silver halides which can be used in this invention include silver chloroiodide, silver bromoiodide and silver bromochloroiodide. Among these, silver chloroiodobromide is preferred. The amount of silver iodide is preferably in the range of 2 to 30 mole %, especially 4 to 10 mole %.

As regards color light-sensitive materials, the amount of silver iodide is preferably in the range of 4 to 15 mole %. Iodide in the grains may be distributed uniformly or unevenly. Especially, grains with high iodide content core, grains having covering layer containing iodide in high content or the like are preferable.

Moreover, it is preferred that the content of silver iodide as a halogen composition in the first emulsion be equivalent to or more than that in the second emulsion.

The average size of the silver halide grains is preferably greater than that of the substantially light-insensitive silver halide grains, particularly not less than 0.6 micron.

The size distribution of the silver halide grains may be narrow or broad The silver halide grains in the emulsions may be of regular crystal form such as cubic or octahedral, of irregular crystal form such as spherical or tabular, or of complex crystal form. The silver halide grains may be a mixture of different crystal form grains.

The tabular silver halide grains having a diameter-to-thickness ratio of 5 or more may be preferably used in this invention. This type of tabular silver halide grain is described in detail in U.S. Pat. Nos. 4,434,226 and 4,434,227, and Japanese Patent Disclosure No. 127921/1983.

The photographic emulsion which can be used in this invention may be prepared by the methods described in, e.g., P. Glafkides, Chimie et Physique Photographique (Paul Montel 1967); G. F. Duffin, Photographic Emulsion Chemistry (The Focal Press. 1966); and V. L. Zelikman et al, Making and Coating Photographic Emulsion (The Focal Press. 1964), that is, by any of an acidic process, a neutral process, an ammonia process, etc. Reaction between a soluble silver salt and a soluble halide salt may be carried out by any of single jet method, double jet method and a combination thereof.

A process for the formation of grains in the presence of excess silver ion (the so-called reverse mixing process) may also be used. A process in which a pAg in a liquid phase in which silver halide is formed is kept constant, which is one of the simultaneous mixing processes and which is the so-called controlled double jet process, can be used. According to this process, silver halide grains having regular crystal form and nearly uniform grain size (mono-dispersed emulsion) can be obtained. A mixture of two or more kinds of silver halide grains which have been separately or differently prepared may be used.

During the formation or physical ripening of silver halide grains, there may be allowed to coexist cadmium salts, zinc salts, lead salts, thallium salts, iridium salts or complex salts thereof, rhodium salts or complex salts thereof, iron salts or complex salts thereof, etc Although a so-called primitive emulsion, which is not chemically sensitized, can be used, the photosensitive silver halide emulsions are usually chemically sensitized. For chemical sensitization, there may be used the method described in H. Frieser, Die Grundlagen der Photographischen Prozesse mit Silverhalpgeniden, pp 675–734 (Akademische Verlagsgesellschaft. 1968)

Namely, sulfur sensitization using a sulfur-containing compound which can react with silver ion or active gelatin, reduction sensitization using a reducing compound, noble metal sensitization using noble metal such as gold, etc. may be used alone or in a combination. As sulfur sensitizers, there may be used thiosulfates, thioureas, thiazoles, rhodanines or the like As reduction sensitizing agents, there may be used stannous salts, amines, hydrazine derivatives, formamidinesulfinic acid, silane compounds or the like. For the purpose of the noble metal sensitization, there may be used, in addition to gold complex salts, other complex salts of the metals of Group VIII of the periodic table, e.g., platinum, iridium, palladium or the like Various compounds may be added to the photographic emulsion used in this invention in order to prevent the reduction of sensitivity or formation of fog during the manufacture, storage or processing of the photographic elements. Examples of such compounds commonly known in the art include 4-hydroxy-6-methyl-1,3,3a,7-tetraazaindene, 3-methyl-benzthiazole, 1-phenyl-5-mercaptotetrazole, other heterocyclic compounds, mercury-containing compounds, other mercapto compounds, metal salts, etc.

Specific examples of such compounds are described in K. Mees, "The Theory of the Photographic Processes" 3rd. ed. (1966) in which many references are made to earlier works, and also include the anti-fog reagents described in Japanese Patent Disclosure Nos. 81024/1979, 6306/1980 and 19429/1980 and U.S. Pat. No. 3,850,639.

Specific examples of the substantially light-insensitive unfogged silver halides which can be used in this invention include silver chloroiodide, silver bromoiodide, silver bromochloroiodide, silver chloride, silver bromochloride, silver bromide. Among these, silver chloride, silver chlorobromide, silver bromide, silver bromiodide containing 2 mole % or less iodide or silver bromochloroiodide containing 2 mole % or less iodide are preferable. The average size of the silver halide grains is preferably 0.05 to 0.4 micron, more preferably 0.3 micron or less, most preferably 0.2 micron or less The size distribution of the silver halide grains is preferably narrow. The silver halide grains in the emulsions may be of regular crystal form such as cubic or octahedral, of irregular crystal form such as spherical or tubular, or of complex crystal form.

The second emulsion can be prepared by the method described in the book of P. Glafkides V. K. Zelikman et al. The so-called conversion type emulsion described in U.S. Pat. No. 2,592,250 may be used as the second emulsion Moreover, the core-shell type emulsion which comprises different halide composition between the core portion and the shell portion may also be used.

During the formation or physical ripening of silver halide grains, there may be allowed to coexist cadmium salts, zinc salts, lead salts, thallium salts, iridium salts or complex salts thereof, rhodium salts or complex salts thereof, iron salts or complex salts thereof, etc.

As regards the second silver halide emulsion, the surface or interior of the grains is not usually chemically sensitized.

The size of the silver halide emulsion grains contained in the second emulsion is preferably 0.4 micron or less, more preferably 0.4 to 0.05 micron, most preferably 0.3 to 0.05 micron.

The size distribution of the silver halide grains may be narrow or broad A so-called monodispersed silver halide emulsion which has a narrow grain size distribution such that 90% or more, preferably 95% or more, of the grains have a grain size within +40% of the average grain size based on the number or the weight of the grains may be used in this invention.

The ratio of the light-sensitive silver halide emulsion (the first emulsion) content to the substantially light-insensitive (unfogged) silver halide emulsion (the second emulsion) in the silver halide photographic light sensitive materials of this invention can be varied depending on the type of emulsions to be used (e.g., halogen composition), the kind or use of the light-sensitive materials to be used and the contrast of the emulsions to be used. The weight ratio of silver of the first emulsion to the second emulsion is preferably 999:1 to 500:500, especially 99:1 to 70:30. The total amount of the silver coated on one side of a support is preferably 0.5 to 7 $g/m^2$, especially 0.5 to 5 $g/m^2$.

There are several possible stratum constructions of the photographic element of this invention, for example, (1) a construction wherein an emulsion layer containing a mixture of the first emulsion and the second emulsion and a protecting layer (subsidiary layer) are provided on a support in this order, (2) the construction of (1) described above, wherein an emulsion layer containing the second emulsion is further provided between the emulsion layer and the protecting layer (subsidiary layer), (3) a construction wherein an emulsion layer containing the first emulsion, an emulsion layer containing the second emulsion and a protecting layer (subsidiary layer) are provided on a support in this order, and (4) a construction wherein an emulsion layer containing the first emulsion and a protecting layer containing the second emulsion.

These stratum constructions may be provided on a single side or both sides of a support.

A subsidinary layer other than a protecting layer may be provided in this invention.

The protecting layer of the silver halide photographic light-sensitive material of this invention is one which comprises a hydrophilic colloids Examples of such hydrophilic colloid are those described earlier. The protecting layer may be of a single layer or a multi layer.

Matting agents and/or smoothing agents may be added to an emulsion layer or a protecting layer of the silver halide photographic light-sensitive material of this invention, preferably to the protecting layer. Examples of the matting agents include organic compounds such as water dispersible vinyl polymers, e.g., polymethylmethacrylate, or inorganic compounds such as silver halides, strontium sulfate, barium sulfate, etc., having particles of a suitable diameter (those having a diameter of 0.3 to 5 microns, or a diameter of more than 2 times, especially more than 4 times the thickness of the protecting layer. Like matting agents, smoothing agents not only aid in the prevention of the problems due to adhesion, but also improve the friction properties which affect its adaptability to the camera during motion picture photography or to the projector during projection. Specific examples of the smoothing agents include liquid paraffins, waxes such as esters of higher aliphatic acids, polyfluorinated hydrocarbons or derivatives thereof, silicones such as polyalkylpolysiloxane, polyarylpolysiloxane, polyalkylarylpolysiloxane, or alkyleneoxide addition derivatives thereof.

The silver halide photographic materials of this invention may contain optionally an antihalation layer, an interlayer, a filter layer, etc.

Various hydrophilic colloids can be used as a binder in the photographic light-sensitive materials of this invention. Examples of such colloids include hydrophilic colloids commonly used in the photographic field, such as, gelatin, colloidal albumin, polysaccharides, cellulose derivatives, synthetic resins, e.g., polyvinyl compounds including polyvinyl alcohol derivatives, polyacrylamides, etc. In combination with the hydrophilic colloids, there may be contained in the photographic elements of this invention, hydrophobic colloids, especially those capable of increasing the dimension stability of the elements Examples of such hydrophobic colloids include water-soluble polymers prepared by the polymerization of such vinyl monomer as alkyl acrylates, alkyl methacrylates, acrylic acid, sulfoalkyl acrylates, sulfoalkyl methacrylates, etc.

The silver halide emulsion layers and other hydrophilic colloid layers of the photographic materials of this invention may be hardened by suitable hardeners. Examples of such hardeners include vinyl sulfonyl compounds as described in Japanese Patent Public Disclosure Nos. 76025/1978, 76026/1978 and 77619/1978; those having an active halogen atom; dioxane derivatives; and oxypolysaccharides such as oxystarch.

Other various additives useful for photographic materials may be added to the silver halide photographic light-sensitive material of this invention Examples of the additives include lubricants, sensitizers, light-absorbing dyes, plasticizers, etc.

The hydrophilic colloid layers used in this invention may contain various water soluble dyes, as a filter dye, or for the purpose of preventing irradiation, halation, etc. Examples of such dyes include oxonol dyes, hemioxonal dyes, styryl dyes, merocyanine dyes, cyanine dyes and azo dyes. Among these dyes, oxonol dyes, hemioxonol dyes and merocyanine dyes are particularly useful.

When dyes or ultraviolet light absorbing agents are contained in the hydrophilic colloid layer of the light-sensitive materials of this invention, a cationic polymer or the like may be used as a mordant.

The light-sensitive materials of this invention may contain surface active agents for various purposes. Depending on the specific purposes, any of nonionic, ionic or ampholytic surface active agents can be used. Examples of such surface active agents include polyoxyalkylene derivatives, ampholytic amino acids (including sulfobetaines), etc. Such surface active agents are described in U.S. Pat. Nos. 2,600,831, 2,271,622, 2,271,623, 2,275,727, 2,787,604, 2,816,920 and 2,739,891 and Belgian Patent No. 652,862. Moreover, the above polyalkylene derivatives are useful as antistatic agents.

In this invention, fluorine-containing compounds can be used as antistatic agents, anti-adhesion agents, anti-slip agents, coating aids, etc. Examples of such compounds include low molecular weight compounds described in Japanese Patent Disclosure Nos. 10722/1974, 16525/1975, 84712/1978, 48520/1979, 14224/1979, 43636/1981, 26719/1982, 146248/1982, 114945/1981, 196544/1983, 200235/1983 and British Patent Nos. 1,259,398 and 1,417,915, polymer compounds described in U.S. Pat. Nos. 4,175,969, 4,087,394, 4,016,125, 3,676,123, 3,679,411 and 4,304,852, Japanese Patent Disclosure Nos. 129520/1977, 158222/1979, 57842/1980, 11342/1982, 19735/1982 and 179839/1982. Japanese Patent Application No. 202438/1985, "Chemical Review, No. 27, New Fluorine Chemical" (The Chemical Society of Japan, 1980), "Functional fluorine-containing polymer" written by Kurokawa (Nikkan Kogyo News Paper, 1982), or inorganic compounds described in Japanese Patent Disclosure No. 165650/1985.

The emulsions, especially the first emulsion, used in the light-sensitive materials of this invention may spectrally be sensitized by sensitizing dyes to blue light having relatively long wavelength, green light, red light or infrared light. Examples of such sensitizing dyes include cyanine dyes, merocyanine dyes, complex cyanine dyes, complex merocyanine dyes, holopolar cyanine dyes, styryl dyes, hemicyanine dyes, oxonol dyes, hemioxonol dyes, etc. The sensitizing dyes, are used in this invention in a similar concentration to that used in conventional negative silver halide emulsions. Especially, it is advantageous to use the sensitizing dyes in such concentration that the inherent sensitivity of the silver halide emulsion is not substantially lowered. For example, the sensitizing dyes may be used in the range of about $1.0\times10^{-5}$ to about $5\times10^{-4}$ mole, preferably about $4\times10^{-5}$ to about $2\times10^{-4}$ mole per one mole of silver halide.

Sensitizing dyes may be added to a photographic emulsion at any preparation step of the emulsion or at any stage from after the preparation of the emulsion to prior to the coating of the emulsion. Examples of such preparation steps include the formation step of silver halide grains, the physically ripening step, the chemically ripening step, etc.

The photographic emulsion layers and other layers of the photographic light-sensitive materials of this invention are coated on one or both sides of a flexible support. Examples of suitable supports include films of synthetic polymers such as cellulose acetate, cellulose butyrate acetate, polystyrene, polyethyleneterephthalate, etc., or paper having coated or laminated thereon a baryta layer, α-olefin polymer (e.g., polyethylene, polypropyrene, ethylenebutene copolymer), etc.

The hydrophilic colloid layers including the photographic emulsion layers of this invention may be applied on a support or other layer by various conventional coating methods such as dipping, roll coating, curtain coating, extrusion coating, etc.

This invention may be applied to any photographic light-sensitive material which requires high sensitivity or high contrast, for example, X-ray photographic light-sensitive materials, Lith-type photographic light-sensitive materials, black-and-white negative photographic light-sensitive materials, color negative light-sensitive materials, color paper light-sensitive materials, etc.

Materials used in the color negative light-sensitive materials, such as color couplers, high boiling point organic solvent are described in Research Disclosure vol. 176, page 22 to 27 (December, 1978).

For the photographic treatment of the photographic light-sensitive materials of this invention, there may be used any of conventional methods and processing solutions as described in Research Disclosure, No. 176, (1978), pages 28 to 30 (RD-17643) These treatments may be a black-and-white photographic processing in which a silver image is formed or a color photographic processing in which a color image is formed. The processing temperature is usually in the range of 18° C. to 50° C., although a temperature lower than 18° C. or higher than 50° C. may also be selected Low activity developing solution obtained by lowering the concentration of developing agent or by acidifying (lowering pH) as well as high activity developing solution can be used as a developing solution in this invention.

For example, the developing bath used in the black-and-white processing may contain developing agents commonly known. Examples of such developing agents include dihydroxybenzenes (e.g. hydroquinone), 3-pyrazolidones (e.g., 1-phenyl-3-pyrazolidone), aminophenols (e.g., N-methyl-p-aminophenol), and mixtures thereof. The photographic light-sensitive materials of this invention may be processed in the developing solution as described in Japanese Patent Public Disclosure No. 78535/1982, which contains imidazoles as a silver halide solvent. The developing solution as described in Japanese Patent Public Disclosure No. 37643/1983, which contains a silver halide solvent and addenda such as indazole or triazole, may also be used. Usually, the developing solutions which can be used for the processing of the photographic materials of this invention further contain preservatives, alkali agents, pH buffers, antifoggants and, if necessary, may further contain dissolving aids, toning agents, development accelerators, surface active agents, defoaming agents, water-softening agents, hardeners, viscosity-imparting agents, etc.

A special type of development may also be applied to the photographic materials of this invention, in which a developing agent is contained in the photographic materials, for example, in the emulsion layer and the photographic materials is processed in an aqueous alkaline solution. Among developing agents, the hydrophobic one can be contained in the emulsion layer by the methods as described in Research Disclosure, No. 169 (RD-16928), U.S. Pat. No 2,739,890, British Pat. No. 813,253 or West German Pat. No. 1,547,763. Such development processing may be combined with a processing for stabilizing silver salt with thiocyanates.

As fixing agents, those having a commonly used formulation can be employed Examples of such fixing agents which can be used include, in addition to thiosulfates and thiocyanates, organic sulfur-containing compounds which are useful as a fixing agent The fixing agents used in this invention may contain water soluble aluminum salts as a hardener.

The basic theory of this invention will be explained below.

When light-sensitive silver halide grains with a high iodine content are developed, iodine ions are released and precipitated immediately on the grains adjacent to the ions. That is, when the development of a grain starts, the rate of development of the grain itself is reduced and the rate of development of other grains adjacent to the said grain is slowed, and the infectious development causes coarse granularity.

Although the use is known of light-insensitive silver salts to reduce the infectious development by capturing the iodine ions released during the development, such silver salts have some side-effects. For instance, they neutralize the action of the active principle in the emulsion by surface adsorption and they prevent the DIR compound from exhibiting the interimaging effect by intercepting a development retardant released from the DIR compound.

The inventors conducted investigations into a surface treating method of the light-insensitive grains which does not prevent the capture of iodine ions and which reduces the neutralization of the effect of the photographically active principle and found that the compound represented by the formula (I) has a preferable effect.

Just why the group of the compound used in this invention has the special effect in comparison with many other compounds which exhibit strong adsorption to silver halide is not certain, but it is considered that the effect is obtained from the irreversible, strong adsorptivity of the compound and a specific adsorption layer construction allowing the exchange of silver halide and iodine ions.

This invention will now be explained in more detail with reference to the following Examples.

Example 1

(1) Preparation of surface light-sensitive silver halide emulsion (first emulsion)

In accordance with the conventional ammonia method, a silver nitrate solution and a solution comprising potassium bromide and potassium iodide were added simultaneously to an aqueous solution comprising potassium bromide, potassium iodide, gelatin and potassium thiocyanate in a vessel to produce silver bromoiodide emulsion (AgI =5 mole%) grains in the form of a thick tabular having a mean diameter of 1.0 micrometer. The grains were de-salted by the conventional aggregation method, chemicaly sensitized by gold-sulfur sensitization using chloroauric acid and sodium thiosulfate and 4-hydroxy-6-methyl-1,3,3a,7-teraazaindene as a stabilizer was then added to obtain a light-sensitive silver bromoiodide emulsion A.

(2) Preparation of light-insensitive fine grain emulsion (second emulsion)

A small amount of ammonia solution was added to a 2% by weight gelatin aqueous solution containing a small amount of potassium bromide at 55° C. under agitation. To the resulting solution was simultaneously added a silver nitrate aqueous solution and a potassium aqueous solution under potentiastatic conditions to form pure silver bromide grains. The grains were desalted by the conventional aggregation method and redispersed in a gelatin aqueous solution to prepare 0.18 micrometer uniformly dispersed pure silver bromide emulsion B-1 (not chemically sensitized). The compound No.6 included in the formula (I) having the following structure was adsorbed to the emulsion B-1.

Compound No. 6

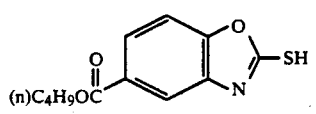

(3) Preparation of emulsion coating solution 3.5 gAg/m$^2$ emulsion A and emulsion B-1 in the amounts shown in Table 1 were mixed. 4-Hydroxy-6-methyl-1,3,3a,7-tetraazaindene (stabilizer), dodecylbenzensulfonate compound (coating aid) and polypotassium-p-vinylbenzensulfanate compound (thickening agent) were added to the obtained mixture. As a comparative sample, the coating solution which is the emulsion A containing the following mesoiontriazolium compound was prepared.

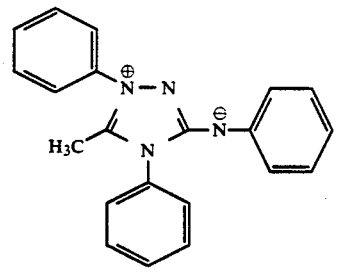

(4) Preparation of coating solution for surface protecting layer

The coating solution comprising gelatin, polyethylene sodium sulfanate (thickening agent), polymethylmethacrylate fine grains (mean grain size=3.0 microns) (mad agent), N,N'-ethylenebis-(vinylsulfonylacetoamide) (hardener), t-octylphenoxyethoxyethane sodium sulfonate (coating aid) and polyoxyethylene surface active agent and fluorine-containing compound having the following structure was prepared.

(5) Preparation of coating sample

The emulsion coating solution was coated on both sides of a polyethyleneterephthalate support such that the amount of coated silver per one side was adjusted to the amont shown in Table 1, the amount of gelatin from the emulsion coating solution was adjusted to 1.84 g/m$^2$ per one side and the amount of gelatin from the coating solution for surface protecting layer was adjusted to 1.35 g/m$^2$. Thus the total coating amount of gelatin was adjusted to 3.19 g/m$^2$ for each sample.

(6) Sensitometry

After the samples were stored at 25° C. and 65% RH humidity for 7 days, the samples were exposed to blue light of to 480 micrometers with a maximum peak at 414 micrometers, using a continuous wedge The processing of the samples including fixing, washing with water and drying was carried out at a standard temperature of 35° C. for 90 seconds by using the following developing solution A and fixing solution and by using a processing machine FPM-4000 available from Fuji Photo Film K.K..

| Formulation of the developing solution A | |
|---|---|
| Potassium hydroxide | 29.14 g |
| Glacial acetic acid | 10.96 g |
| Potassium sulfite | 44.20 g |
| Sodium bicarbonate | 7.50 g |
| Boric acid | 1.00 g |
| Diethyleneglycol | 28.96 g |
| Ethylenediaminetetraacetic acid | 1.67 g |
| 5-Methylbenztriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium metabisulfite | 12.60 g |
| Potassium bromide | 7.00 g |
| Water to | 1 l |
| | pH 10.25 |
| **Formulation of the fixing solution** | |
| Ammonium thisulfate | 200 g |
| Sodium sulfite | 20 g |
| Boric acid | 8 g |
| Ethylenediaminetetraacetic acid | 0.1 g |
| Aluminium sulfate | 15 g |
| Sulfuric acid | 2 g |
| Glacial acetic acid | 22 g |
| Water to | 1 l |
| | pH 4.2 |

Sensitometry of the processed photographic materials was carried out; the results are shown in Table 1. In the Table, the sensitivity value is shown as a relative value of the logarithm of the inverse amount of exposure required to obtain +0.3 fogging of the optical density of the silver image under transmitted light to the sensitivity of Compound No. 1 in the Table (1.00).

Graininess was evaluated and expressed as follows. Samples were prepared by exposure to the same light used for the sensitometry uniformly under such condition that the optical density of the silver image under transmitted light is 1.0 when developed under the standard developing conditions (35° C. for 25 seconds). The density of the sample was measured by a microdensitometer with an aperture of 24 micrometers. The value obtained by substituting the squared average of the density (RMS) was taken as the granularity. A higher value means a coarse grain. The granularity was evaluated as follows:

| | |
|---|---|
| RMS value of 0.05 or more | 1 |
| RMS value of 0.046 to less than 0.05 | 2 |
| RMS value of 0.042 to less than 0.046 | 3 |
| RMS value of 0.038 to less than 0.042 | 4 |
| RMS value of less than 0.038 | 5 |

Moreover, the same samples were developed by using the following developing solution B, not by means of an automatic developing processor but by tray development at 20° C. for 2 minutes and 4 minutes. Fixing and water washing were carried out in the same manner.

| Formulation of the developing solution B | |
|---|---|
| 1-phenyl-3-pyrazolidone | 0.5 g |
| Hydroquinone | 20.0 g |
| Ethylenediaminetetraacetic acid | 2.0 g |
| Potassium sulfite | 60.0 g |
| Boric acid | 40 g |
| Potassium carbonate | 20.0 g |
| Sodium bromide | 5.0 g |
| Diethylene glycole | 30.0 g |
| Water to | 1 l |
| NaOH to | ph = 10.0 |

The results were indicated as a relative value, as in the case of the developing solution A, to the sensitivity of the sample No. 1 developed for 4 minutes (1.00).

TABLE 1

| Sample No. | Amount of second emulsion B-1 gAg/m$^2$ (one side) | Added amount of Compound (I)-No. 6 adsorbed on emulsion B-1 mole/mole Ag(B-1) | Added amount of Compound A mole/mole Ag | Photographic property of developing solution-A sensitivity | Graininess (Developing solution-A) | Photographic property of developing solution-B Sensitivity (2 minutes developing) | Sensitivity (4 minutes developing | Remarks |
|---|---|---|---|---|---|---|---|---|
| 1 | — | — | — | 1.00 | 1 | 0.78 | 1.00 | Comparative example |
| 2 | — | — | $2.3 \times 10^{-3}$ | 0.75 | 4 | 0.55 | 0.74 | Comparative example |
| 3 | 0.15 | — | — | 0.91 | 2 | 0.66 | 0.95 | Comparative example |
| 4 | 0.15 | $1 \times 10^{-3}$ | — | 0.99 | 4 | 0.86 | 1.02 | This invention |
| 5 | 0.15 | $3 \times 10^{-3}$ | — | 0.96 | 4 | 0.88 | 1.05 | This invention |
| 6 | 0.15 | $9 \times 10^{-3}$ | — | 0.92 | 5 | 0.91 | 1.07 | This invention |

Table 1 shows the following:

The samples (No. 4 to 6) containing an emulsion of AgBr fine grains on which the compound represented by the general formula (I) of this invention was adsorbed exhibit good granularity when developed by the developing solution A in comparison with the sample (No. 1) not containing such emulsion. On the other hand, when the samples were developed by the developing solution B, especially when the developing period was short, the samples exhibited high sensitivity. Moreover, the samples of this invention exhibited high sensitivity compared with the sample (No. 2) containing mesoiontriazonium which had substantially equivalent granularity to the samples of this invention. This high sensitivity was marked when the developing period was short.

Example 2

For a light-insensitive fine grain emulsion, silver chloride grains were formed using the same method as Example 1 (by adding simultaneously a silver nitrate aqueous solution and a sodium chloride solution under potentiostatic conditions) and de-salted by the conventional aggregation method. The obtained grains were redispersed in a gelatin solution to produce 0.20 micrometer monodispersed silver chloride emulsion B-2 (not chemically sinsitized). The compound No.23 included in the compound represented by the general formula (I) was adsorbed on the dispersed grains (emulsion B-1) in the same amount as Example 1.

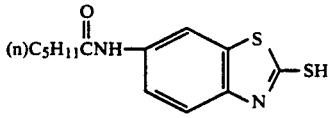

Compound No. 23

The coating samples was prepared by using the emulsion under the same conditions as Example 1 and the sensitometry was conducted The sample containing an emulsion of silver chloride fine grain on which the compound No.23 was adsorbed clearly had good granularity when the samples were developed by the developing solution A, compared with the comparative sample. The samples exhibited high sensitivity in comparison with the comparative sample when the samples were developed for a short period by the developing solution.

Example 3

The same experiment as in Example 1 was conducted using the same procedure as Example 1 except that 1-pheny-5-mercaptotetrazole, in the same amount as in Example 1 was used in place of the compound No. 6 included in the general formula (I) as a surface adsorber for the subtantially non-light-sensitive fine grain emulsion B-1 used in Example 1 However, the sensitivity was markedly reduced and the technical effect obtained from the samples of this invention could not be obtained.

Example 4

Sensitometry tests were conducted according to the procedure of Example 2 except that the respective compounds Nos. 1, 8, 12, 25, 36 were used in place of the compound No.23 used for light-insensitive silver halide fine grains emulsion. The consistently good results were obtained in the case of each sample using the above compounds.

Example 5

For a light-insensitive fine grain emulsion silver chloride grains were formed using the same method as Example 1 (by adding simultaneously a silver nitrate aqueous solution, a sodium chloride solution and a potassium bromide under potentiostatic conditions) and de-salted by the conventional aggregation method. The obtained grains were redispersed in a gelatin solution to produce 0.19 micrometer monodispersed silver chlorobromide (silver chloride 30: silver bromide 70) emulsion B-3 (not chemically sensitized).

In accordance with the same procedure as the above (by adding simultaneously a silver nitrate aqueous solution, a potassium bromide aqueous soultion and a potassium iodide aqueous solution under potentiostatic conditions), 0.19 micrometer monodispersed silver iodobromide (silver iodide 2: silver bromide 98) emulsion B-4 (not chemically sinsitized) was obtained The compound No. 40 included in the compound represented by the general formula (I) was adsorbed on the dispersed grains (emulsion B-3 and B-4) in the same amount as Example 1.

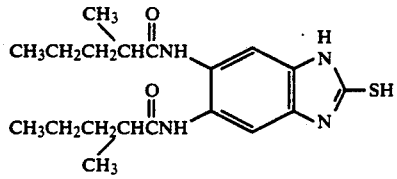

Compound No. 40

The coating samples was prepared by using the emulsion under the same conditions as Example 1 and the sensitometry was conducted. The sample containing an emulsion silver chlorobromide and silver iodobromide fine grains on which the compound No.40 was adsorbed clearly had good granularity when the samples were developed by the developing solution A, compared with the comparative sample. The samples exhibited high sensitivity in comparison with the comparative sample when the samples were developed for a short period by the developing solution.

Advantages of the Invention

Granularity was conspicuously improved by using both light-sensitive silver halide emulsion containing silver iodide (first emulsion) and substantially light-insensitive or unfogged silver halide emulsion having adsorbed the compound of this invention thereon when the photographic materials are developed by the developing solution containing dialdehyde at an elevated temperature Moreover, the rate of development of the photographic materials can be improved when the materials are developed at a low temperature for a relatively short period.

We claim:

1. A silver halide photographic light-sensitive material having at least one silver halide photographic emulsion layer coated on at least one said of a support, wherein said photographic emulsion layer comprises a light-sensitive silver halide emulsion containing silver halide grains including silver iodide and said photographic emulsion or other layer(s) of the material contains a substantially light-insensitive, unfogged silver halide fine grain emulsion, wherein the sensitivity of said substantially light-insensitive, unfogged silver halide fine grain emulsion is more than 100 times lower than that of said light-sensitive silver halide emulsion, and wherein a heterocyclic mercapto compound represented by the following general formula (I) is adsorbed on the fine grains of said fine grain emulsion: general formula (I)

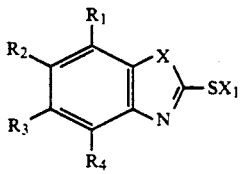

wherein X represents —O—, —NH—, or —S—; $R_1$, $R_2$, $R_3$ and $R_4$ are a hydrogen atom or a substituent group; at least one of $R_1$, $R_2$, $R_3$ and $R_4$ is a substituted or unsubstituted alkyl or aryl group having up to 13 carbon atoms, such alkyl or aryl being bonded directly or through a divalent linkage group to the aromatic nucleus; $X_1$ represents a hydrogen atom or a cation, such cation being required to neutralize the molecule.

2. The silver halide photographic light-sensitive material of claim 1 wherein X of the general formula (I) is —O—.

3. The silver halide photographic light-sensitive material of claim 1 wherein X of the general formula (I) is —NH—.

4. The silver halide photographic light-sensitive material of claim 1 wherein X of the general formula (I) is —S—.

5. The silver halide photographic light-sensitive material of claim 1 wherein $X_1$ of the general formula (I) is hydrogen.

6. The silver halide photographic light-sensitive material of claim 1 wherein $R_1$, $R_2$ and $R_3$ of the general formula (I) are hydrogen atoms and $R_3$ is a substituted or unsubstituted alkyl or aryl group having up to 13 carbon atoms, such alkyl or aryl being bonded directly or through a divalent linkage group to the aromatic nucleus.

7. The silver halide photographic light-sensitive material of claim 1 wherein $R_1$ and $R_4$ of the general formula (I) are hydrogen atoms and $R_2$ is a substituted or unsubstituted alkyl or aryl group having up to 13 carbon atoms, such alkyl or aryl being bonded directly or through a divalent linkage group to the aromatic nucleus and $R_3$ is a substituent group.

8. The silver halide photographic light-sensitive material of claim 1 wherein $R_1$ and $R_4$ of the general formula (I) are hydrogen atoms and $R_2$ is a substituted group and $R_3$ is a substituted or unsubstituted alkyl or aryl group having up to 13 carbon atoms, such alkyl or aryl being bonded directly or through a divalent linkage group to the aromatic nucleus.

9. The silver halide photographic light-sensitive material of claim 1 wherein $R_1$, $R_3$ and $R_4$ of the general formula (I) are hydrogen atoms and $R_2$ is a substituted or unsubstituted alkyl or aryl group having up to 13 carbon atoms, such alkyl or aryl being bonded directly or through a divalent linkage group to the aromatic nucleus.

10. The silver halide photographic light-sensitive material of claim 1 wherein $R_1$ and $R_4$ of the general formula (I) are hydrogen atoms and $R_2$ and $R_3$ are substituted or unsubstituted alkyl or aryl group having up to 13 carbon atoms, such alkyl or aryl being bonded directly or through a divalent linkage group to the aromatic nucleus.

11. The silver halide photographic light-sensitive material of claim 1 wherein the light-sensitive silver halide emulsion is a surface latent type emulsion.

12. The silver halide photographic light-sensitive material of claim 1 wherein the silver halide of the light-sensitive silver halide material comprises silver bromoiodide.

13. The silver halide photographic light-sensitive material of claim 12 wherein the iodide content ranges from about 2 to about 30 mole %.

14. The silver halide photographic light-sensitive material of claim 1 wherein said light-insensitive silver halide comprises at least one compound selected from the group consisting of silver chloride, silver bromochloride, silver bromide and silver bromoiodide.

15. The silver halide photographic light-sensitive material of claim 1 wherein the mean grain size of the light-insensitive silver halide comprises 0.05 to about 0.4 micron.

16. The silver halide photographic light-sensitive material of claim 1 wherein the light-insensitive silver halide emulsion is not chemically sensitized.

17. The silver halide photographic light-sensitive material of claim 1 wherein the silver halide grains are monodispersed.

18. A processing method of a silver halide photographic light-sensitive material comprising treating an imagewise exposed silver halide photographic sensitive material of claim 1 with a developing solution.

19. The processing method of claim 18 wherein the developing solution contains a dialdehyde hardener.

* * * * *